US010655788B2

(12) United States Patent
Hilton

(10) Patent No.: US 10,655,788 B2
(45) Date of Patent: May 19, 2020

(54) HIGH PRESSURE VOLUMETRIC FLUID METERING DEVICE

(71) Applicant: Thomas Joseph Hilton, Kirkland, WA (US)

(72) Inventor: Thomas Joseph Hilton, Kirkland, WA (US)

( * ) Notice: Subject to any disclaimer, the term of this patent is extended or adjusted under 35 U.S.C. 154(b) by 508 days.

(21) Appl. No.: 15/360,628

(22) Filed: Nov. 23, 2016

(65) Prior Publication Data

US 2017/0146195 A1 May 25, 2017

Related U.S. Application Data

(60) Provisional application No. 62/259,441, filed on Nov. 24, 2015.

(51) Int. Cl.
*F17D 3/12* (2006.01)

(52) U.S. Cl.
CPC ..... *F17D 3/12* (2013.01)

(58) Field of Classification Search
CPC ..... F16K 3/32; F16D 25/14; E21B 33/035; E21B 43/26
USPC ..... 166/344
See application file for complete search history.

(56) References Cited

U.S. PATENT DOCUMENTS 3,951,311 A 4/1976 Johansson
4,653,533 A * 3/1987 Tanigawa ..... F16D 25/14 137/565.11
5,427,139 A 6/1995 Hilton
5,494,070 A 2/1996 Hilton
6,189,564 B1 2/2001 Hilton
6,283,727 B1 9/2001 Borish et al.
6,973,936 B2 12/2005 Watson
7,343,929 B2 3/2008 Hilton
2012/0006556 A1 1/2012 McHugh et al.
2012/0298696 A1 11/2012 Milo et al.

FOREIGN PATENT DOCUMENTS

WO 2006/027562 A1 3/2006

OTHER PUBLICATIONS

International Search Report and Written Opinion dated Feb. 17, 2017, issued in corresponding International Application No. PCT/US2016/63642, filed Nov. 23, 2016, 12 pages.

* cited by examiner

*Primary Examiner* — Angelisa L. Hicks
(74) *Attorney, Agent, or Firm* — Polsinelli PC

(57) ABSTRACT

A high pressure volumetric fluid metering device for controlling the flow of fluid from a high pressure fluid supply source to a process line includes a modulator configured to pump a predetermined volume of high pressure fluid at a predetermined flow rate and an oscillator in fluid communication with the high pressure fluid supply source. The oscillator is configured to selectively direct high pressure fluid from the high pressure fluid supply source toward the modulator and further configured to direct the predetermined volume of high pressure fluid pumped out of the modulator toward an oscillator outlet. The metering device further includes a differential pressure regulator configured to substantially maintain the pressure differential across the modulator and oscillator.

20 Claims, 12 Drawing Sheets

HIGH PRESSURE VOLUMETRIC FLUID METERING DEVICE

CROSS-REFERENCE TO RELATED APPLICATION

This application claims the benefit of U.S. Provisional Application No. 62/259,441, filed Nov. 24, 2015, the disclosure of which is hereby expressly incorporated by reference in its entirety herein.

BACKGROUND

Many types of equipment and industrial processes require accurate control of the flow of liquid and gaseous fluids over a broad range of fluid pressure and flow rates. Current valve technology used for accurately controlling the flow of liquid and gaseous fluids over fluctuating fluid pressures and flow rates are typically referred to as injection rate control devices (IRCD), metering valves, flow valves, or the like (hereinafter sometimes collectively referred to as IRCD).

An IRCD design may have a fixed orifice, where the differential pressure across the valve is maintained via a piston that is biased by springs that open and close an outlet valve to maintain the constant pressure differential, as shown and described in U.S. Pat. No. 6,189,564, entitled "Metering Valve," issued on Feb. 20, 2001, the disclosure of which is hereby incorporated by reference herein. An IRCD design may instead have a variable orifice controlled by electrical or mechanical means.

Current IRCD technology lacks the ability to fully adapt and compensate for fluctuating system conditions, such as changes in viscosity, pressure, temperature, debris, or specific gravity. For instance, when an IRCD is used on an off-shore oil rig, the oil is retracted from the ground at extremely high pressures, and it is often mixed with gas, water, rocks, sand, gravel, etc. The oil mix must be treated with chemicals as soon as it is pumped out of the ground, when the conditions are constantly changing and unpredictable.

Accordingly, one aspect of the present disclosure is directed to a metering device that can accurately measure and inject liquids and gaseous fluids, such as treatment chemicals, into a process line at a controlled rate regardless of fluctuating conditions.

Current IRCD technology also lacks the ability to meter very low injection rates, which are becoming more prevalent with improved efficiency of injected liquids and gaseous fluids, such as treatment chemicals. IRCD technology has typically been designed to inject liquid and gaseous fluids at a rate of about 10 to 50 liters/hour. Improved industrial processes may now require injection flow rates at about 0.02 to 3 liters/hour.

Accordingly, another aspect of the present disclosure is directed to a metering device that can accurately measure and inject liquids and gaseous fluids, such as treatment chemicals, into a process line at a very low, controlled injection rate.

Current IRCD technology is also becoming more automated. However, automating injection of liquids and gaseous fluids in a high pressure and fluctuating environment can be costly and bulky. For instance, an injection point in a process line may include a flow meter, an injection valve, and an actuator, which are each individually costly and take up valuable real estate in confined areas such as an offshore platform.

Accordingly, yet another aspect of the present disclosure is directed to a metering device that incorporates all the aspects of a flow meter, an injection valve, and an actuator with less complexity for reducing cost and overall size.

SUMMARY

A high pressure volumetric fluid metering device for controlling the flow of fluid from a high pressure fluid supply source to a process line includes a modulator configured to pump a predetermined volume of high pressure fluid at a predetermined flow rate and an oscillator in fluid communication with the high pressure fluid supply source. The oscillator is configured to selectively direct high pressure fluid from the high pressure fluid supply source toward the modulator and further configured to direct the predetermined volume of high pressure fluid pumped out of the modulator toward an oscillator outlet. The metering device further includes a differential pressure regulator configured to substantially maintain the pressure differential across the modulator and oscillator.

In another aspect, a method of controlling the flow of fluid from a high pressure fluid supply source to a process line includes selectively directing high pressure fluid from the high pressure fluid supply source through a first high pressure fluid flow path of an oscillator toward a modulator, pumping a first predetermined volume of high pressure fluid from the modulator to the oscillator, directing the first predetermined volume of high pressure fluid through a second flow path of the oscillator toward a process line, and substantially maintaining the pressure drop across the oscillator and the modulator.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

The detailed description set forth below in connection with the appended drawings is intended as a description of at least one exemplary embodiment of the disclosed subject matter and is not intended to represent the only embodiment. The exemplary embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known subassemblies and/or process steps have not been described in detail in order not to unnecessarily obscure various aspects of the present disclosure. Further, it will be appreciated that embodiments of the present disclosure may employ any combination of features described herein.

The present disclosure includes references to directions, such as "inner," "outer," "upward," "downward," "top," "bottom," "left", "right", "first," "second," etc. These references and other similar references in the present application are only to assist in helping describe and understand the present invention and are not intended to limit the present invention to these directions. Also, the terms "liquids and gaseous fluids," "high pressure fluids," "fluids," "treatment chemicals," etc., will collectively be sometimes hereinafter referred to as "treatment fluids."

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. The terms "about," "approximately," etc., mean plus or minus 5% of the stated value.

Figure 1:
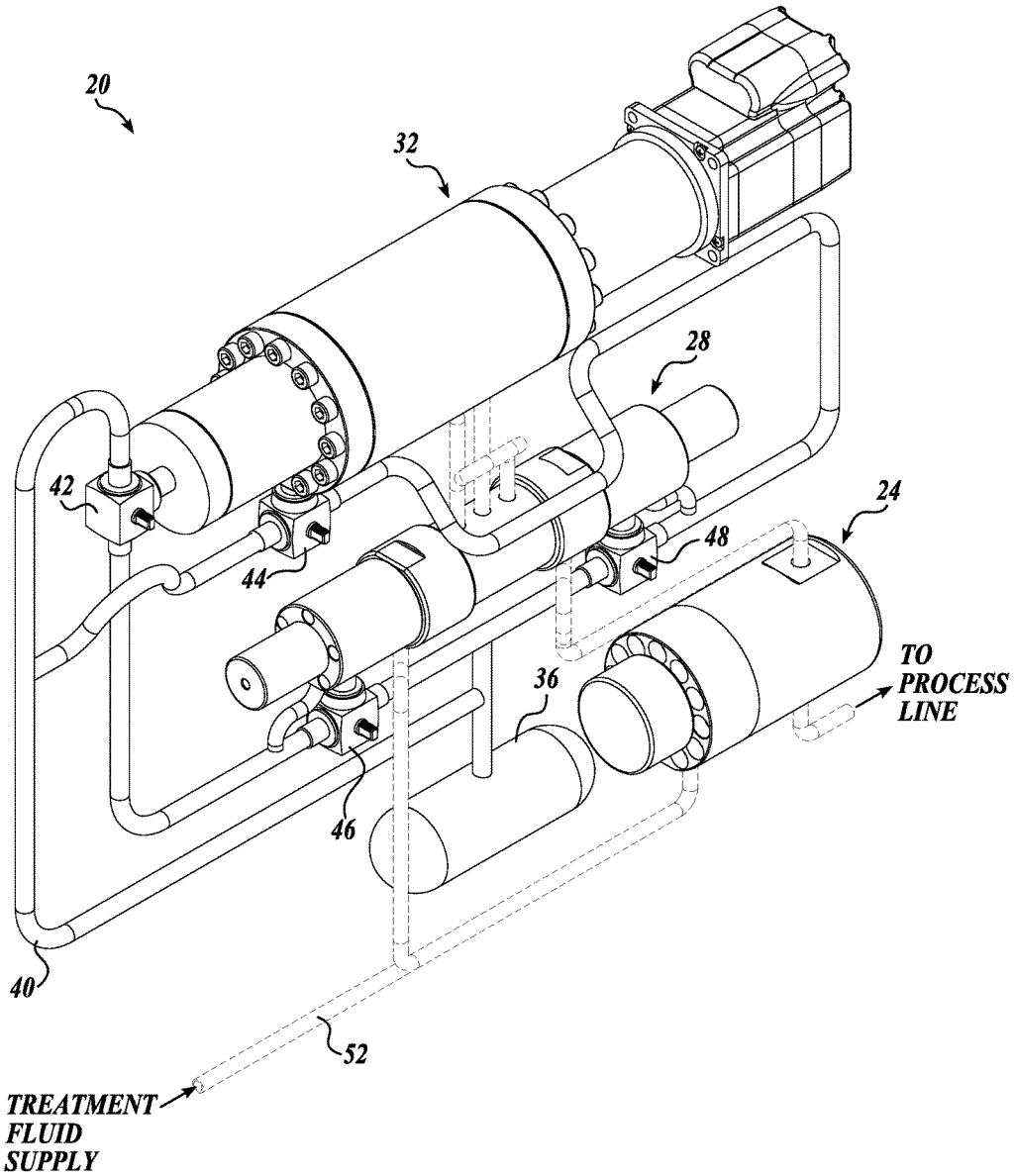
FIG. 1 is an isometric view of a high pressure volumetric metering device formed in accordance with an exemplary embodiment of the present disclosure.

Referring to FIG. 1, an exemplary embodiment of a high pressure volumetric metering device 20 will now be described. In general, the high pressure volumetric metering device 20 (hereinafter sometimes referred to as the "device 20") is configured to accurately measure and inject treatment fluids at a very low, controlled injection rate into a process line, regardless of fluctuating conditions upstream or downstream of the device 20, with a less complex and more compact footprint that prior art systems and devices. In that regard, the high pressure volumetric metering device 20 includes a differential pressure regulator 24 configured to substantially maintain the pressure drop across the device 20 regardless of fluctuations in pressure upstream or downstream of the device 20. The device 20 further includes a modulator 32 configured to meter and control the flow rate of the treatment fluid flowing into the process line, and an oscillator 28 that is configured to selectively direct treatment fluid flow to and from the modulator 32. A control unit 34 (see FIGS. 11-12) is configured to control the oscillator 28 and modulator 32 for maintaining a desired treatment fluid flow rate while accurately measuring the volume of treatment fluid passing through the device 20.

The fluid regulating components of the device 20, i.e., the differential pressure regulator 24, the oscillator 28, and the modulator 32, are in fluid communication with each other and with fluid sources through low and high pressure lines. More specifically, the differential pressure regulator 24, the oscillator 28, and the modulator 32, are in fluid communication with a high pressure treatment fluid supply source (and any necessary pump) and with each other through a high pressure line 52 (shown dashed for clarity). The high pressure line 52 is also in fluid communication with the process line into which the treatment fluid is injected.

The oscillator 28 and modulator 32 are also in fluid communication with each other and with a low-pressure hydraulic reservoir 36 through a low-pressure loop 40. The low-pressure hydraulic fluid selectively flows into and out of the oscillator 28 and modulator 32 to actuate the oscillator 28, as will become apparent from the description that follows. In that regard, the low pressure loop 40 includes first, second, third, and fourth valves 42, 44, 46, and 48, respectively, which can be selectively opened or closed to selectively allow the flow of low-pressure hydraulic fluid into and out of the oscillator 28 and modulator 32. In the depicted embodiment, the valves 42, 44, 46, and 48 are three-way solenoid valves; however, any suitable valves or other mechanisms may instead be used to direct fluid flow.

It should be appreciated that although the components of the device 20 (i.e., the differential pressure regulator 24, the modulator 32, the oscillator 28, and the control unit 34) are shown as separate components for clarity, some or all of the device components may be integrated into a single assembly.

Figure 2:
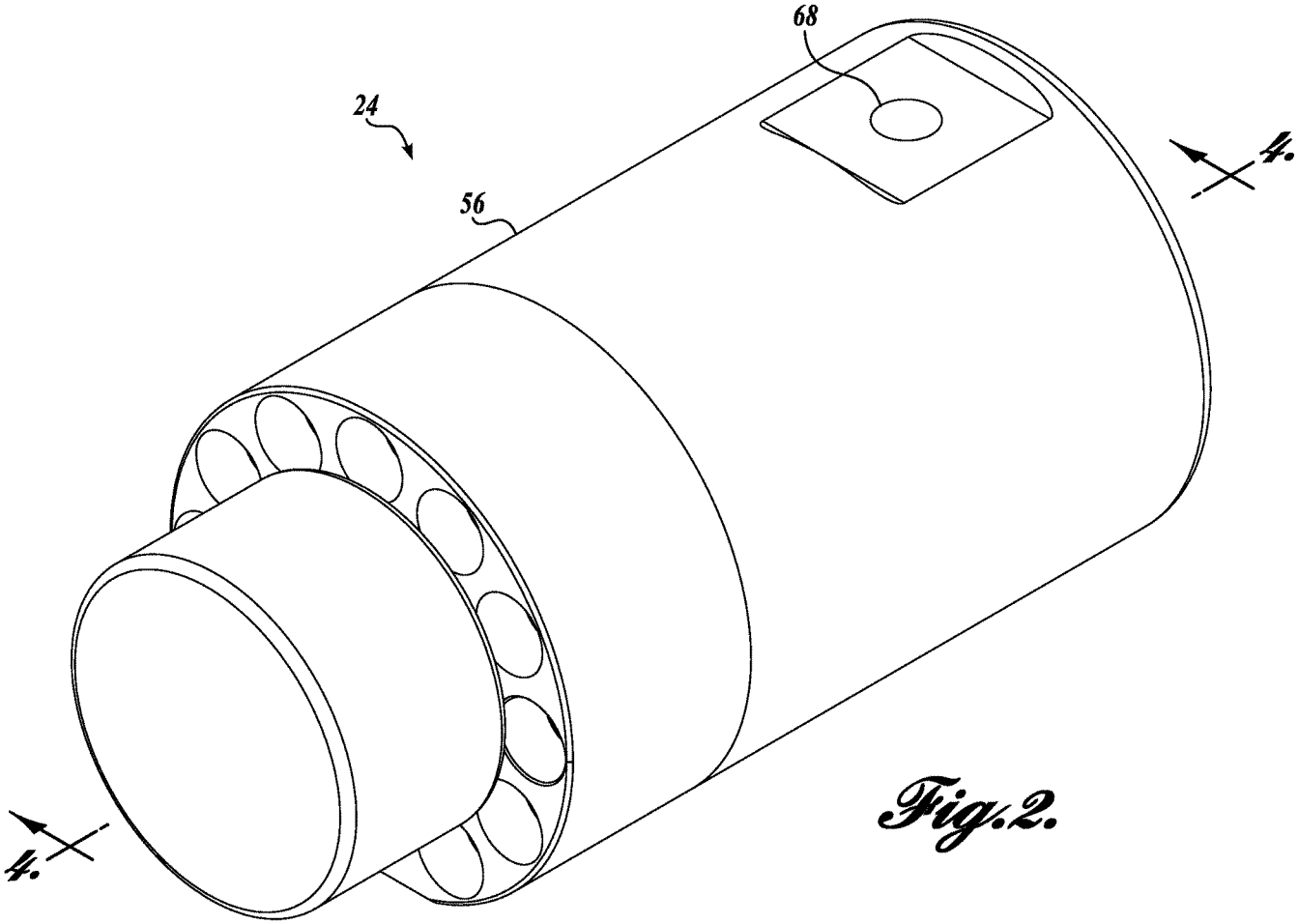
FIG. 2 is an isometric view of a differential pressure regulator of the high pressure volumetric metering device of FIG. 1.
Figure 3:
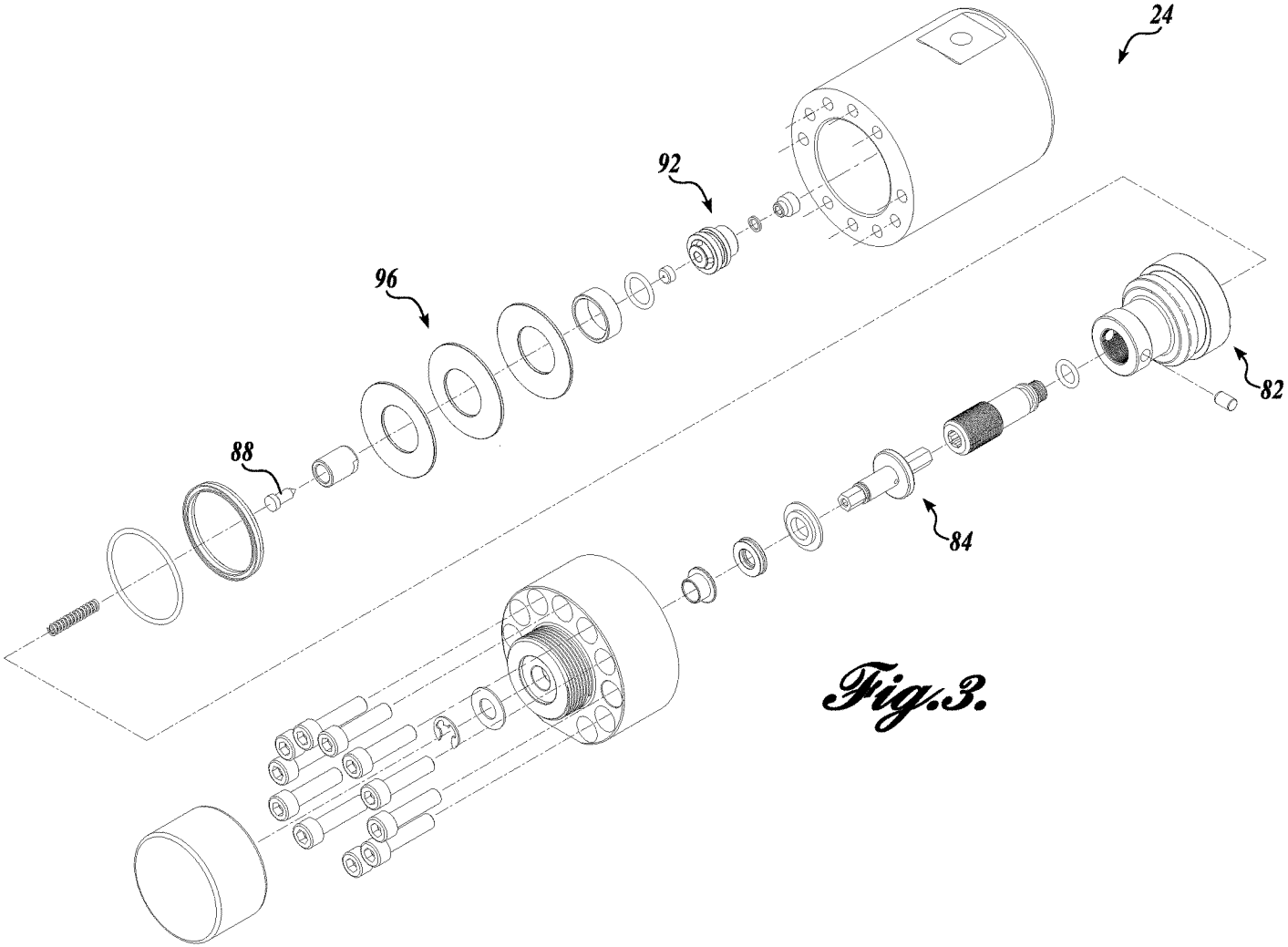
FIG. 3 is an exploded view of the differential pressure regulator of FIG. 2.
Figure 4:
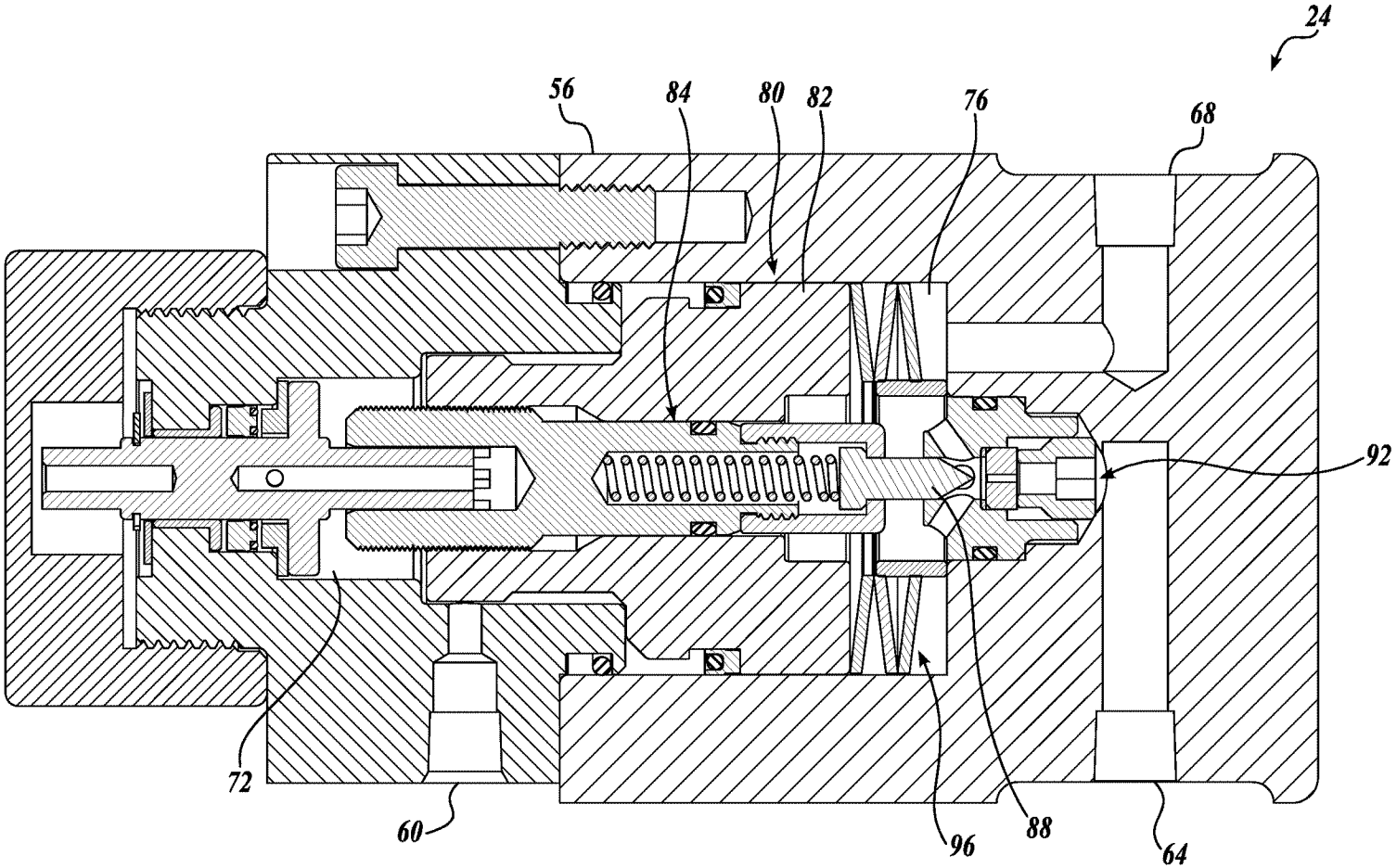
FIG. 4 is a cross-sectional view of the differential pressure regulator of FIG. 2, taken substantially across line 4-4.

Referring to FIGS. 2-4, the differential pressure regulator 24 will now be briefly described. As noted above, the differential pressure regulator 24 is generally configured to maintain the pressure drop across the device 20 regardless of upstream or downstream fluctuations in pressure. More specifically, the differential pressure regulator 24 maintains a substantially constant pressure drop between a high pressure treatment fluid inlet and a metered treatment fluid outlet leading to a process line. The differential pressure regulator 24 is substantially similar in structure and function to the metering valve 10, shown and described in U.S. Pat. No. 5,427,139, entitled "Metering Valve with Adjustable Floating Piston and Pin Assembly" issued on Jun. 27, 1995, the disclosure of which is expressly incorporated by reference herein. Accordingly, the differential pressure regulator 24 will only be briefly described with differences from the metering valve 10 shown in U.S. Pat. No. 5,427,139, highlighted for brevity.

A pressure regulator housing 56 that suitably encloses the internal components of the differential pressure regulator 24 includes a first high pressure inlet 60 configured to be placed into fluid communication with a treatment fluid supply source, a second high pressure inlet port 68 configured to be placed into fluid communication with the oscillator 28, and an outlet port 64 configured to be placed into fluid communication with a process line. The interior of the pressure regulator housing 56 defines a central bore having several counter bore portions (not labeled) suitable for receiving internal components of the differential pressure regulator 24.

The central bore receives a pressure regulator piston assembly 80 to define a first pressure regulator cavity 72 above the assembly 84 and a second pressure regulator cavity 76 below the assembly 84. The first pressure regulator cavity 72 is in fluid communication with the first high pressure inlet port 60, and the second pressure regulator cavity 76 is in fluid communication with the second high pressure inlet port 68 and the outlet port 64. The pressure regulator piston assembly 80 substantially balances the pressure of fluid between the first high pressure inlet port 60 and the second high pressure inlet port 68 as it exits the outlet port 64.

In that regard, the pressure regulator piston assembly 80 includes a floating piston 86 that is slidable axially within the central bore of the housing 54. Appropriate sealing components, such as one or more O-rings, are disposed between the floating piston 82 and the internal surface of the housing 56 defined by the central bore to prevent fluid from passing from the first pressure regulator cavity 72 to the second pressure regulator cavity 76.

In operation, treatment fluid from the treatment fluid supply enters first inlet port 60 and fills the first pressure regulator cavity 72 to impose pressure on an upper end of the floating piston 82. At the same time, treatment fluid from the oscillator 28 enters second inlet port 68 and fills the second pressure regulator cavity 76 to impose an opposing pressure against the floating piston 82. The upper and lower portions of the floating piston 82 are substantially equal in area; accordingly, the floating piston 82 is moved axially by the higher pressure source (i.e., fluid entering inlet port 60 or fluid entering inlet port 68). In that regard, the pressure difference between inlet ports 60 and 68 is a function of the difference in pressure between the two sources.

That pressure difference between inlet ports 60 and 68 is controlled by a biasing assembly 96 disposed within the second pressure regulator cavity 76 between an interior end of the housing central bore and a lower end of the floating piston 82. The biasing assembly 96 is configured to urge the floating piston 84 axially away from the second pressure regulator cavity 76. Although any suitable biasing assembly 96 may be used, in the depicted embodiment, the biasing assembly 96 is configured as a plurality of stacked spring washers. In effect, the differential pressure becomes a function of a spring force (Fx) of the biasing assembly 96.

The biasing assembly 96 may be preloaded a desired amount by translating a pin assembly 84 axially within or out of the floating piston 82 to adjust the initial axial position of the floating piston 82 for compressing or releasing the biasing assembly 96. The pin assembly 84 may be threaded within the floating piston 82 to axially translate the floating piston 82 within the central bore. The pin assembly 84 may be turned by a knob (not shown) external to the differential pressure regulator housing 56 or by other suitable means.

The pin assembly 84 also selectively allows fluid to flow out of the second pressure regulator cavity 76 toward the outlet port 64. In that regard, the pin assembly 84 includes a needle 88 disposed at its distal or lower end that is selectively engageable with a valve assembly 92. The needle 88 is moved into and out of engagement with the valve assembly 92 to selectively allow fluid flow through the valve assembly 92 and out through the pressure regulator outlet port 64. The selective engagement of the needle 88 with the valve assembly 92 is controlled by the balanced movement of the floating piston 84.

The controlled movement of the needle 88 into and out of engagement with the valve assembly 92 results in a substantially constant differential between the inlet pressure at the first high pressure inlet port 60 and the resultant pressure of the device 20 at the second high pressure inlet port 68. Accordingly, the metered high pressure treatment fluid is outleted through outlet port 64 to the process line at a substantially constant pressure regardless of pressure fluctuations in the device 20 and/or in the process line. It should be appreciated that any other suitable pressure regulating device may instead be used without departing from the scope of the present disclosure.

Figure 5:
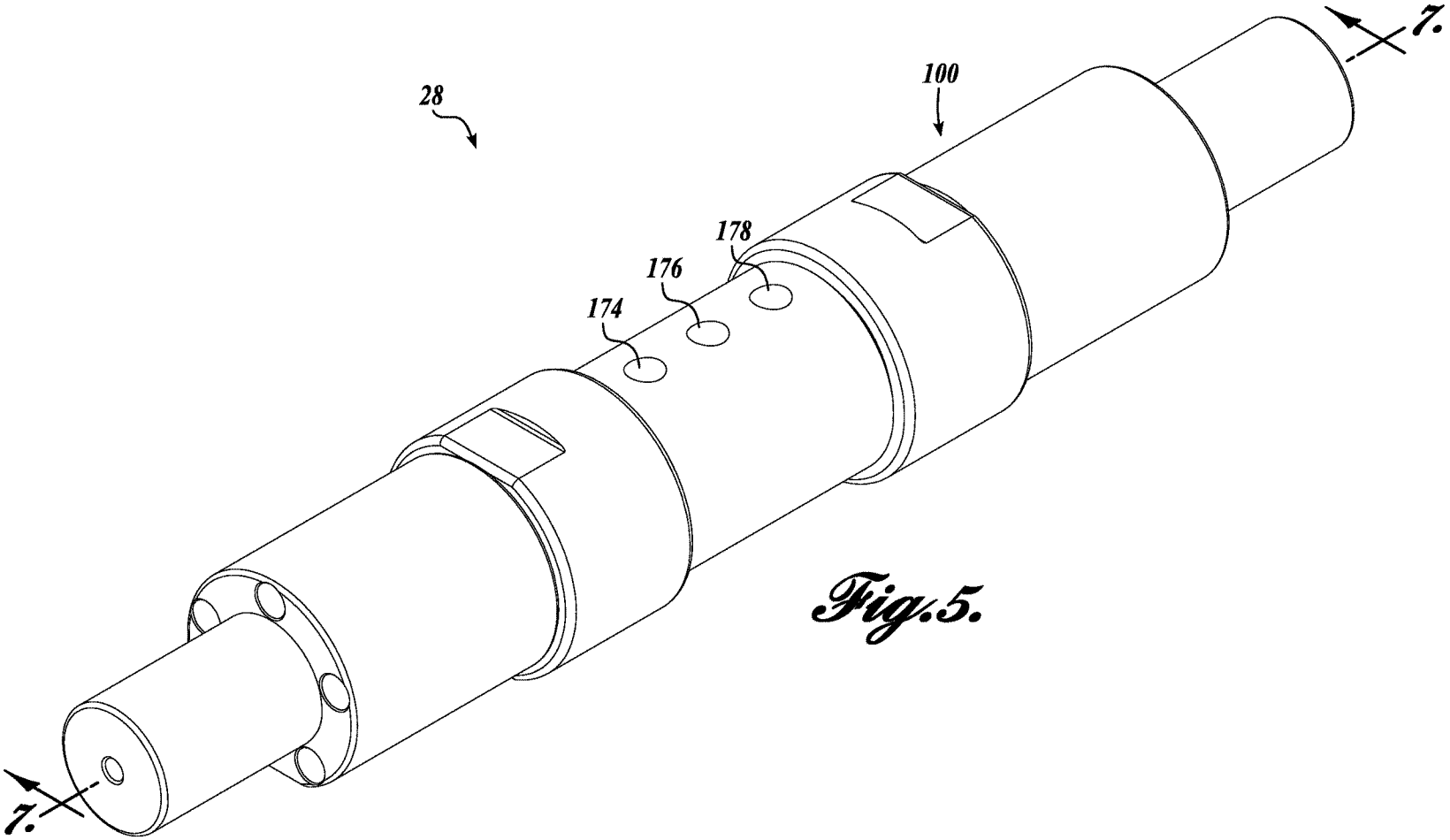
FIG. 5 is a an isometric view of a modulator of the high pressure volumetric metering device of FIG. 1.
Figure 6:
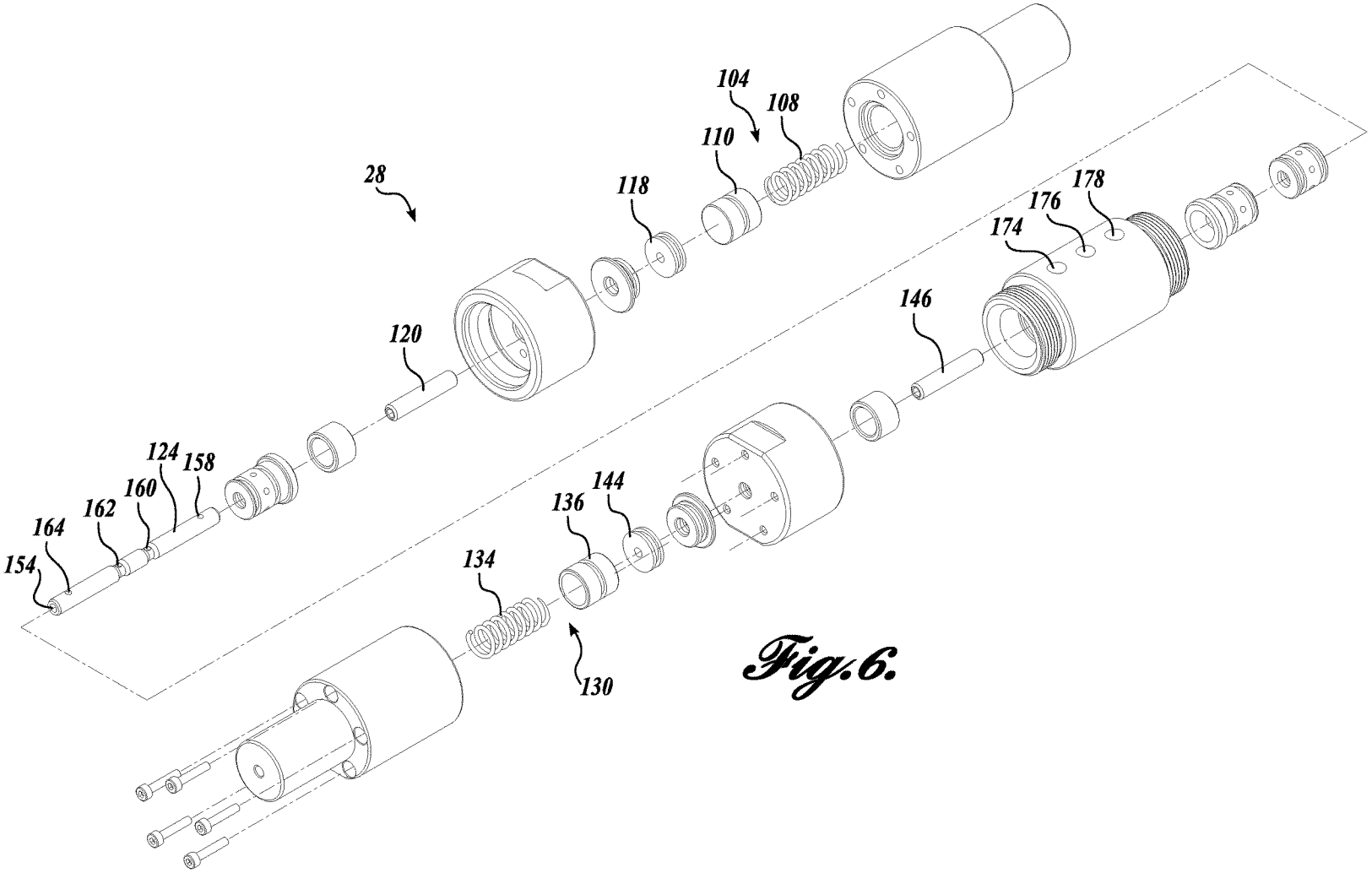
FIG. 6 is an exploded view of the modulator of FIG. 5.
Figure 7:
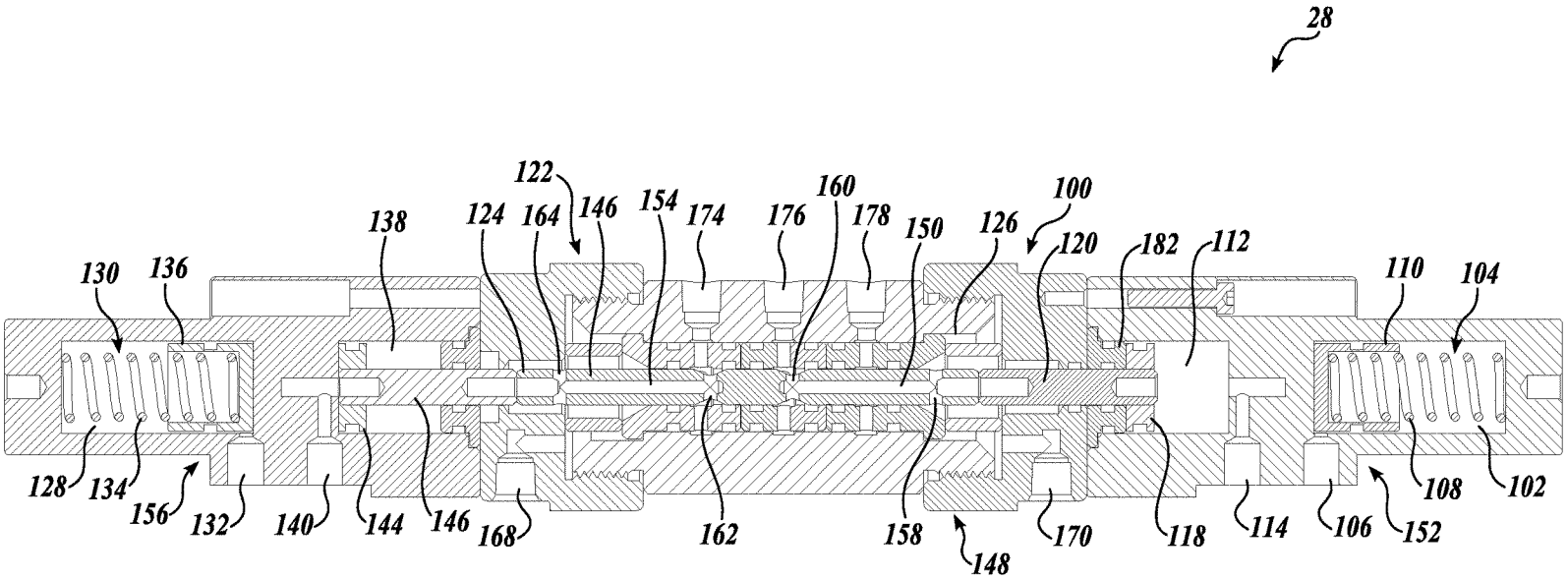
FIG. 7 is a cross-sectional view of the modulator of FIG. 5, taken substantially across line 7-7.

Referring to FIGS. 5-7, the oscillator 28, which selectively allows treatment fluid to flow to and from the modulator 32, and which directs metered treatment fluid to the differential pressure regulator 24, will now be described in detail. The oscillator 28 includes an oscillator housing assembly 100 that encloses the internal components of the oscillator 100 and defines internal cavities therein for receiving and allowing fluid to flow therethrough. The oscillator housing assembly 100 may be defined by a plurality of components bolted, threaded, or otherwise secured together, to collectively define the oscillator housing assembly 100. In the embodiment depicted, the oscillator housing assembly 100 includes a central housing portion 148 disposed between first and second end housing portions 152 and 156.

Referring specifically to FIG. 7, the oscillator 28 includes a suitable assembly for selectively directing the flow of treatment fluid into designated inlet ports of the modulator 32 and selectively directing the flow of metered treatment fluid from the modulator 32 to the differential pressure regulator 24. Although any suitable assembly may be used, in the depicted embodiment, the oscillator 28 includes a slide valve assembly 122 that is moveable between at least first and second positions to create at least first and second treatment fluid flow paths.

The slide valve assembly 122 includes a slide valve 124 slidably and substantially coaxially disposed within a central housing portion bore 126 defined in the middle portion 148 of the oscillator housing 100. The slide valve 124 is generally an elongated cylindrical member having a first central slide valve bore 150 extending from a middle portion of the slide valve 124 toward a first end of the slide valve 124, and a second central slide valve bore 154 extending from a middle portion of the slide valve 124 toward a second, opposite end of the slide valve 124.

The first and second central slide valve bores 150 and 154 are not in fluid communication with each other. Rather, the first central slide valve bore 150 is in fluid communication with a first slide valve port 158 extending substantially transversely through the slide valve 124 near the first end of the slide valve 124, and a second slide valve port 160 extending substantially transversely through the slide valve 124 near the middle of the slide valve 124. Similarly, the second central slide valve bore 154 is in fluid communication with a third slide valve port 162, extending substantially transversely through the slide valve 124 near the middle of the slide valve 124, as well as a fourth slide valve port 164 extending substantially transversely through the slide valve 124 near the second end of the slide valve 124.

The first central slide valve bore 150 is in fluid communication with a high pressure inlet 168 defined in the central housing portion 148 of the oscillator housing assembly 100 through the fourth slide valve port 164. The high pressure inlet 168 is configured to be placed into fluid communication with the treatment fluid supply source to allow treatment fluid to flow into the slide valve 124 of the oscillator 28. The second central slide valve bore 154 is in fluid communication with a high pressure outlet 170 defined in the central housing portion 148 of the oscillator housing assembly 100 through the first slide valve port 158. The high pressure outlet 170 is configured to direct treatment fluid out of the oscillator 28 toward the differential pressure regulator 24.

The slide valve 124 is moveable axially to the left and the right within the central housing portion bore 126 to place the second and third slide valve ports 160 and 162 into and out of fluid communication with first, second, and/or third modulator interface ports 174, 176, and/or 178 defined in the central housing portion 148 of the oscillator housing assembly 100 (and in the embodiment depicted, in a position diametrically opposite the inlet 168 and outlet 170). The first, second, and third modulator interface ports 174, 176, and 178 extend from exterior of the oscillator housing assembly 100 into the central housing portion bore 126. In that regard, cylindrical bore spacers/sealing elements (not labeled) may be concentrically disposed around the slide valve 124 within the central housing portion bore 126 to appropriately seal and define fluid flow paths from the first, second, and third modulator interface ports 174, 176, and 178 to the slide valve 124.

As the slide valve 124 is moved axially into an extreme position to the left, as shown in FIG. 7 (and also in FIG. 11), the fourth slide valve port 164 is in fluid communication with the high pressure inlet 168, which allows treatment fluid to enter the oscillator 28 and flow into the slide valve 124. In this same left-most extreme position, the third slide valve port 162 is in fluid communication with the first modulator interface port 174, which allows the treatment fluid to exit the slide valve 124 and flow toward the modulator 32.

At the same time, the second slide valve port 160 is in fluid communication with the second modulator interface port 176, which allows fluid to flow back from the modulator 32 and into the slide valve 124 of the oscillator 28. Moreover, the first slide valve port 158 is in fluid communication with the high pressure outlet port 170 to allow the returned treatment fluid to flow from the oscillator 28 toward the differential pressure regulator 24.

Figure 12:
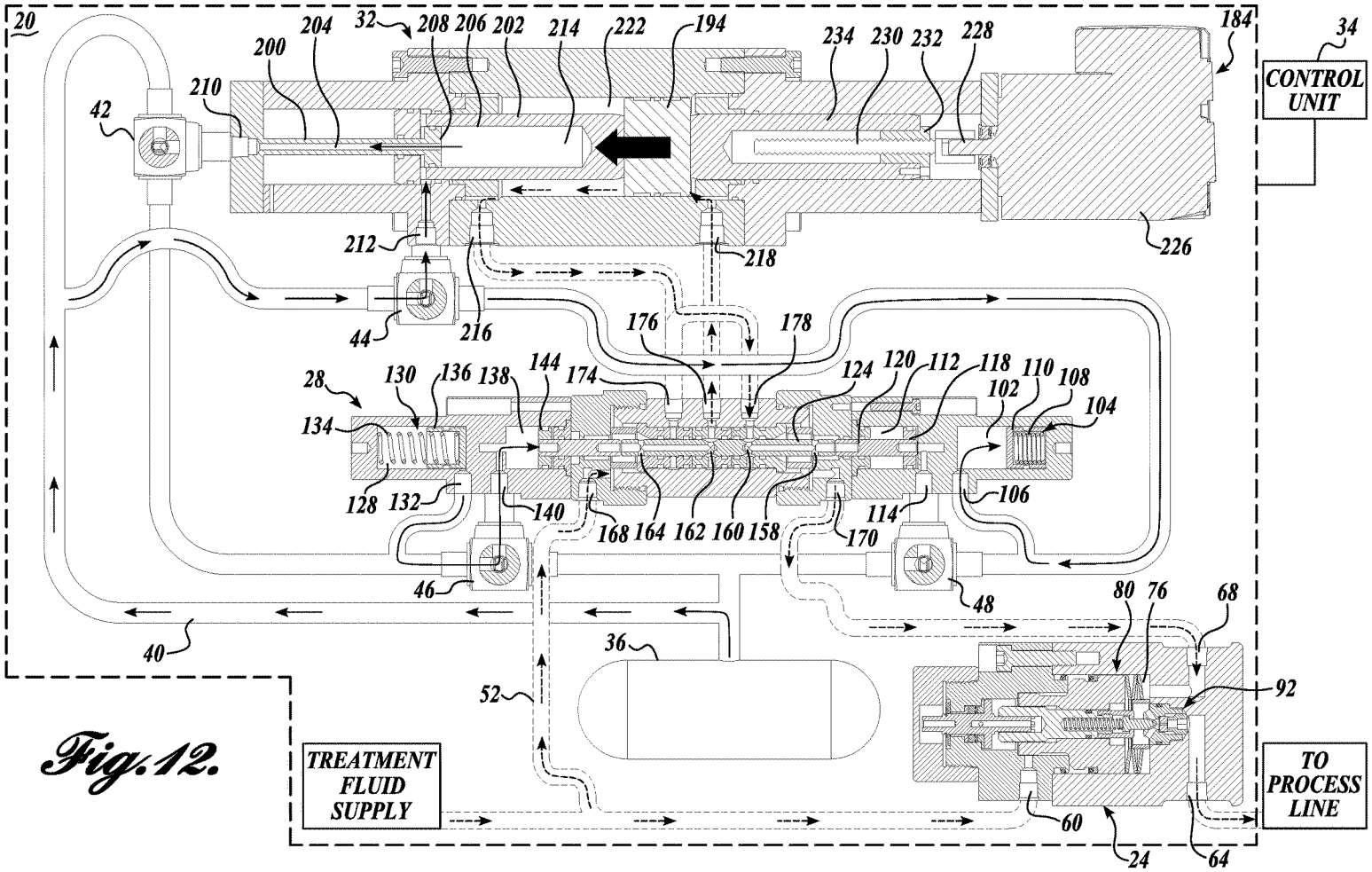
FIG. 12 is a partial cross-sectional view of the high pressure volumetric metering device of FIG. 1, wherein a second fluid flow path through the device is shown.

When the slide valve 124 is moved axially to an extreme right position, as shown in FIG. 12, the second and third slide valve ports 160 and 162 shift in their position, thereby altering the fluid flow path from the slide valve 124 to and from the modulator 32. More specifically, when the slide valve moves axially to the right, the third slide valve port 162 is now in fluid communication with the second modulator interface port 176. As such, treatment fluid flows into the high pressure inlet 168, into the fourth slide valve port 164, through the second central slide valve bore 154, out the third slide valve port 162, and out the second modulator interface port 176 toward the modulator 32.

In the same right-most extreme right position, as shown in FIG. 12, the second slide valve port 160 is in fluid communication with the third modulator interface port 178 to allow fluid to be returned from the modulator 32 to the oscillator 28. More specifically, treatment fluid flows from the modulator 32, into the third modulator interface port 178, into the second slide valve port 160, through the first central slide valve bore 150, out the first slide valve port 158, and out the outlet port 170. Accordingly, it can be appreciated that the slide valve assembly 122 is used to selectively direct the flow of treatment fluid between the oscillator 28 and the modulator 32.

Referring again to FIG. 7, the slide valve assembly 122 can be moved between at least first and second axial positions within the central housing portion bore 126 by any suitable electrical, mechanical, or electromechanical means. In the depicted embodiment, the oscillator 28 is powered by a hydraulic assembly; however, it should be appreciated that the oscillator 28 may instead by powered by pneumatic means, electric or mechanical actuators, etc., without departing from the spirit and scope of the present disclosure. In the exemplary embodiment described and illustrated herein, a hydraulic loop was chosen to power the oscillator 28 because the energy required to actuate the slide valve assembly 122 is considerable with the device 20 operating at very high pressures. Accordingly, the slide valve 124 must be quickly repositioned between its first and second, or left and right, positions for altering treatment fluid flow to and from the modulator 32.

The hydraulic components of the oscillator 28 will now be described. The oscillator 28 includes first and second biasing assemblies 104 and 130 disposed within the first and second end housing portions 152 and 156 of the oscillator housing assembly 100. The first and second biasing assemblies 104 and 130 are substantially identical; therefore only the first biasing assembly 104 will be described in detail.

The first biasing assembly 104 is disposed within a first biasing assembly cavity 102 defined within the first end housing portion 152 of the oscillator housing assembly 100. The first biasing assembly cavity 102 is sized and shaped to receive a first biasing member, such as a first compression spring 108 therein in an extended or substantially nonbiased state. A first pusher 110 is disposed within the first biasing assembly cavity 102 that is configured to compress the first compression spring 108 when hydraulic fluid enters the first biasing assembly cavity 102, and it is configured to push fluid out of the first biasing assembly cavity 102 when the first compression spring 108 extends.

In that regard, the first pusher 110 is substantially cylindrical in shape and has an external diameter that substantially matches the interior diameter of the first biasing assembly cavity 102. The first pusher 110 also has a cross-sectional size and shape to suitably receive a first end of the first compression spring 108. More specifically, the first pusher 110 is disposed on the first end of the compression spring 108 such that it may compress the first compression spring 108 when hydraulic fluid enters the first biasing assembly cavity 102, and it will be moved axially by the first compression spring 108 when the first compression spring 108 extends. To that end, the first pusher 110 includes a suitable annular sealing component, such as an O-ring (not shown), for preventing fluid from passing by the first pusher 110. As such, the first pusher 110 may be moved by the pressure of the hydraulic fluid and it may force the hydraulic fluid out of the cavity 102.

Referring briefly to FIG. 12, the operation of the first biasing assembly 104 will now be described. Referring first to FIG. 12, hydraulic fluid enters a first oscillator low-pressure port 106 in the first end housing portion 152 and acts against the upper surface of the first pusher 110 to move the first pusher 110 axially to the right, thereby compressing the first compression spring 108. In this preloaded configuration, the compression spring 108 can quickly extend to move hydraulic fluid out of the first oscillator low-pressure port 106 by the force of the first pusher 110. Upon exiting the first oscillator low-pressure port 106, the hydraulic fluid is directed into a second oscillator low-pressure port 114, which then enters a first oscillator internal fluid cavity 112 defined in the first end housing portion 152 between the first biasing assembly cavity 102 and the central housing portion bore 126.

A first end of the slide valve 124 extends into the first oscillator internal fluid cavity 112 through a first slide valve connecting rod 120 (which may instead be simply defined by the side valve 124 itself). The first end of the first side valve connecting rod 120 is connected to a first slide valve piston 118 slidably disposed within and substantially corresponding in shape and size to the first oscillator internal fluid cavity 112. The first oscillator internal fluid cavity 112 is fluidly sealed off from the central housing portion bore 126 through a suitable sealing member 182 (having O-rings disposed within interior and exterior annular grooves). In that regard, the sealing member 182 seals against the first slide valve connecting rod 120 as it is moved into and out of the first oscillator internal fluid cavity 112, and it also seals against the interior of the first oscillator internal fluid cavity 112. Accordingly, fluid entering the first oscillator internal fluid cavity 112 does not pass into the central housing portion bore 126, but rather, only acts against the first slide valve piston 118 with its pressure.

Figure 11:
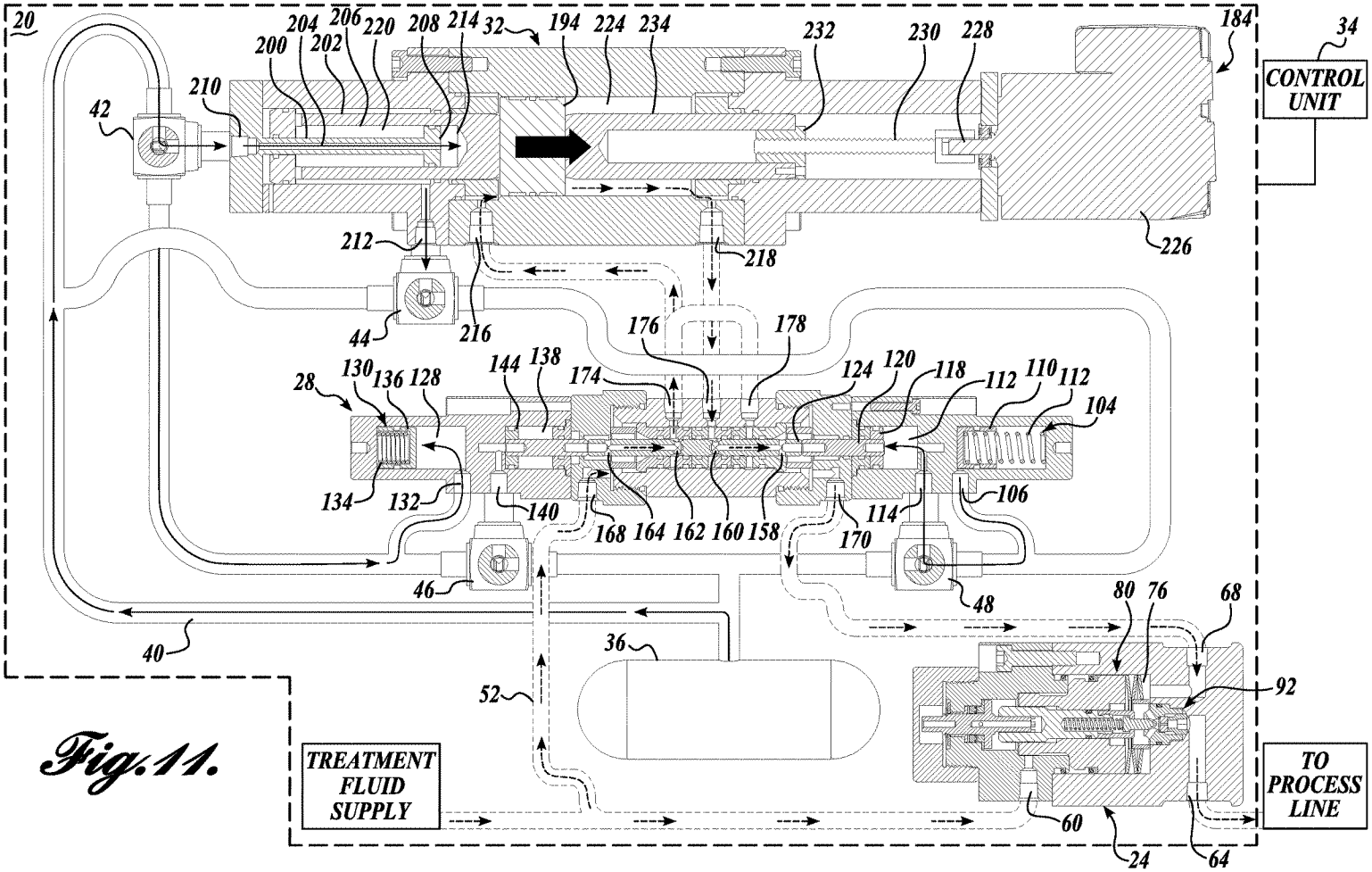
FIG. 11 is a partial cross-sectional view of the high pressure volumetric metering device of FIG. 1, wherein a first fluid flow path through the device is shown.

Referring to FIG. 11, hydraulic fluid flows into the second oscillator low-pressure port 114 when the compression spring 108 extends and acts upon the first slide valve piston 118 to move it axially to the left within the first oscillator internal fluid cavity 112. When the first slide valve piston 118 moves axially to the left, the slide valve 124 correspondingly slides the same distance to the left.

The oscillator 28 includes identical structure in the second end housing portion 156 for moving the slide valve 124 in the opposite axial direction. More specifically, a second biasing assembly 130 is movably disposed within a second biasing assembly cavity 128, wherein the second biasing assembly 130 similarly includes a second compression spring 134 that can be compressed (preloaded) for moving a second pusher 136.

Referring to FIG. 11, hydraulic fluid enters a third oscillator low-pressure port 132 to compress the second compression spring 134, and the hydraulic fluid exits port 132 when the second compression spring 134 extends. Upon extending, the hydraulic fluid enters a fourth oscillator low pressure port 140 to fill a second oscillator internal fluid cavity 138 and axially move a second slide valve piston 144 mounted to a second or opposite end of the slide valve 124 through a second slide valve connecting rod 146, as shown in FIG. 12.

Accordingly, the hydraulic fluid moves the slide valve 124 axially to the left and right to selectively place the second and third slide valve ports 160 and 162 of the slide valve 124 into fluid communication with one of the modulator interface ports 174, 176, and 178. It should be appreciated that any other suitable structure may be used to hydraulically move the slide valve 124. Moreover, as noted above, other suitable electrical, mechanical, or electromechanical means may instead be used to move the slide valve 124 between first and second axial positions.

Figure 8:
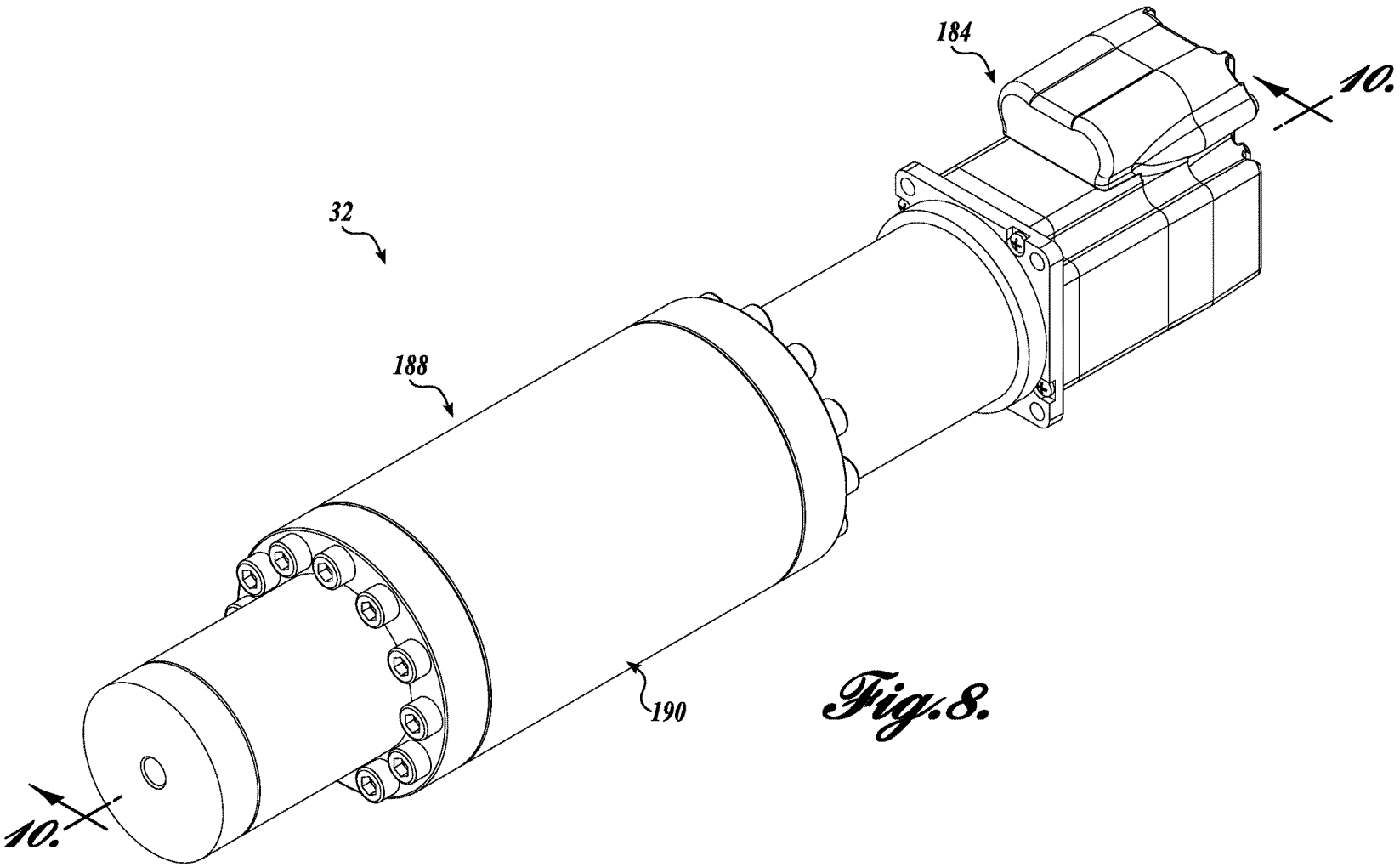
FIG. 8 is an isometric view of an oscillator of the high pressure volumetric metering device of FIG. 1.
Figure 9:
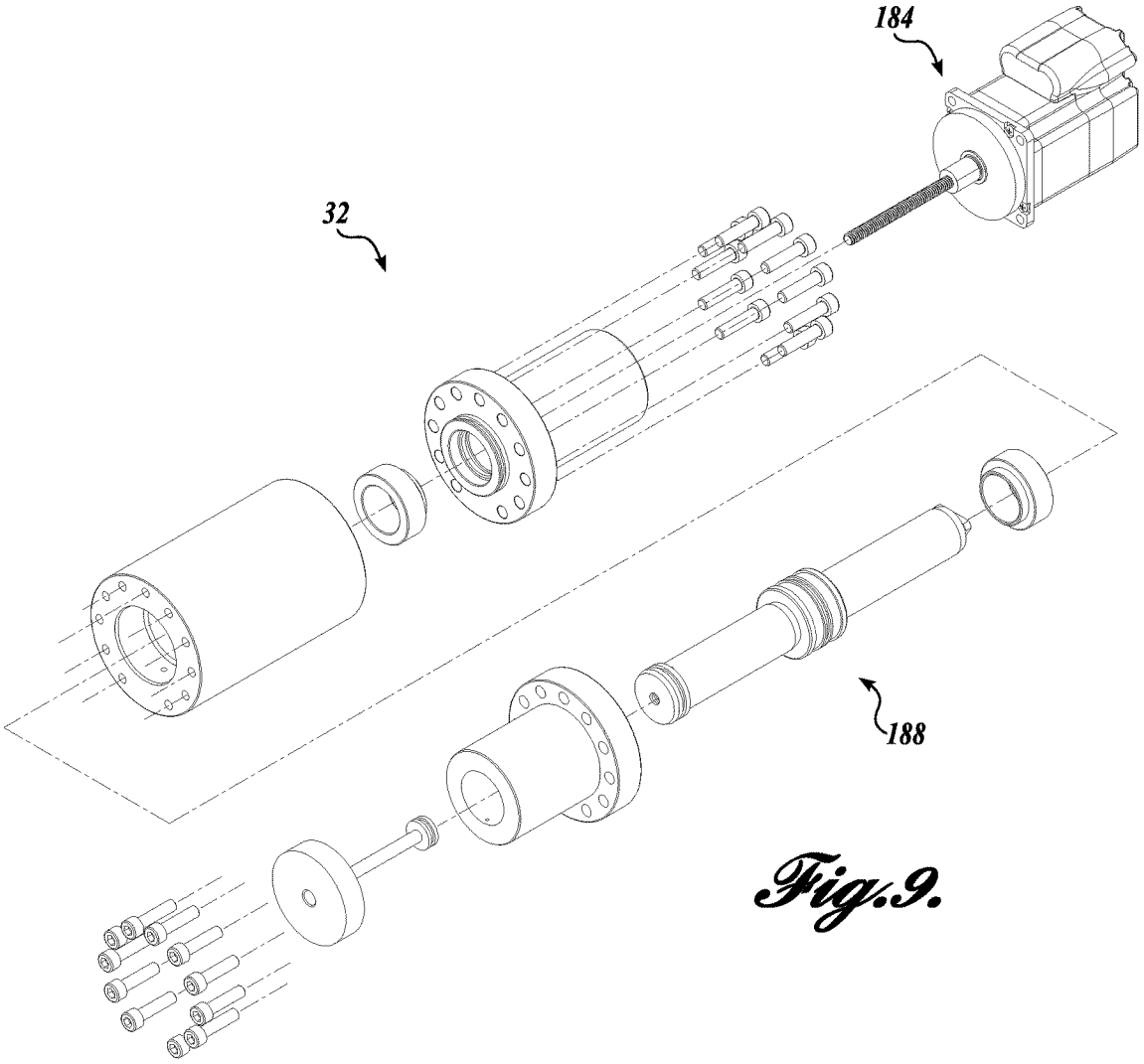
FIG. 9 is an exploded view of the oscillator of FIG. 8.
Figure 10:
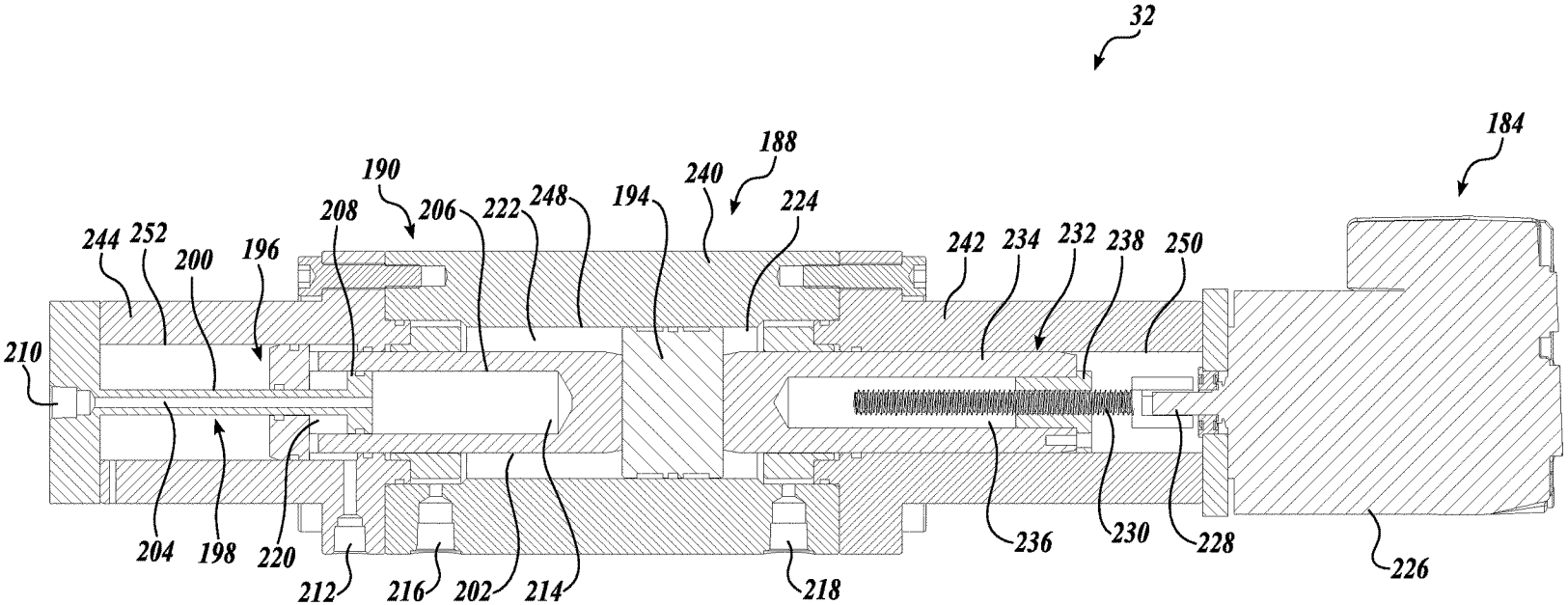
FIG. 10 is a cross-sectional view of the oscillator of FIG. 8, taken substantially across line 10-10.

Referring to FIGS. 8-10, the modulator 32, which is configured to pump out a predetermined (metered) volume of treatment fluid received from the oscillator 28 at a low, controlled flow rate while simultaneously pumping low pressure hydraulic fluid to designated inlet ports of the oscillator 28 for actuating the oscillator 28, will now be described in detail. The modulator 32 includes a modulating device 184 that interfaces with and controls a piston assembly 188 housed within a central housing portion 240 of a modulator housing 190. The modulator housing 190 may be made from a plurality of components bolted, threaded, or otherwise secured together, or the housing 190 may be instead one integral component. In the embodiment depicted, the modulator housing 190 includes a central housing portion 240 disposed between first and second end housing portions 242 and 244.

The central housing portion 240 includes a central housing bore 248 extending axially along its length that houses and movably receives a portion of the piston assembly 188 therein. Specifically, the central housing bore 248 slidably receives a floating piston 194 having an exterior diameter that is substantially the same shape and size as the interior diameter of the central housing bore 248. Moreover, the floating piston 194 includes at least one exterior annular groove for receiving a sealing element, such as an O-ring, therein for sealing against the interior of the central housing bore 248. As such, the floating piston 194 divides the central housing bore 248 into first and second internal metered fluid cavities 222 and 224 whose volumetric capacity is determined by the axial position of the floating piston 194 within the central housing bore 248. In that regard, the floating piston 194 is moved axially back and forth (from left to right shown in FIG. 10) within the central housing bore 248 to pump treatment fluid out of either the first or second internal metered fluid cavity 222 or 224 to be sent back to the oscillator 28 and ultimately to the differential pressure regulator 24. It should be appreciated that any other suitable structure may instead be used to pump metered treatment fluid out of the modulator 32.

The first and second internal metered fluid cavities 222 and 224 are at their maximum volumetric capacity when the floating piston 194 is at a right-most and left-most extreme position, respectively, within the central housing bore 248. More specifically, when the floating piston 194 is moved all the way to the right within the central housing bore 248, the first internal metered fluid cavity 222 is at its maximum volumetric capacity. When the floating piston 194 is moved in the opposite direction to the left hand side of the central housing bore 248, the second internal metered fluid cavity 224 is at its maximum volumetric capacity. Moreover, the maximum volumetric capacity of the first internal metered fluid cavity 222 is substantially equivalent to the maximum volumetric capacity of the second internal metered fluid cavity 224. This maximum volumetric capacity of the first and second internal metered fluid cavity 222 or 224 is equivalent to the maximum volume of treatment fluid pumped out of the modulator 32 that is ultimately injected into a process line.

In that regard, the first internal metered fluid cavity 222 is in fluid communication with a first high pressure port 216 for allowing treatment fluid to flow into and out of the first internal metered fluid cavity 222. Likewise, the second internal metered fluid cavity 224 is in fluid communication with a second high pressure port 218 for allowing treatment fluid to flow into and out of the second internal metered fluid cavity 224. Treatment fluid flows into one of the first or second internal metered fluid cavities 222 or 224 to move the floating piston 194 axially to the right or left within the central housing bore 248, thereby forcing treatment fluid out of the other of the first or internal metered fluid cavity 222 or 224. As a specific example, when treatment fluid flows into port 216 and into the first internal metered fluid cavity 222, the pressure of the treatment fluid moves the floating piston 194 axially to the right, thereby pumping any treatment fluid in the second internal metered fluid cavity 224 out of outlet 218. Similarly, when treatment fluid flows into port 218 and into the second internal metered fluid cavity 224, the piston 194 is moved axially to the left, thereby pumping any treatment fluid in the first internal metered fluid cavity 222 out through port 216. Ports 216 and 218 are selectively placed into communication with ports 174, 176, and/or 178 of the oscillator 128 to direct fluid flow into the appropriate metered fluid cavity 222 or 224 of the modulator 32. Thus, it can be appreciated that the floating piston 194, when moved axially within the central housing bore 248, pumps a predetermined volume of treatment fluid out of ports 216 or 218.

The modulating device 184 is used to control or reduce the speed of the floating piston 194, thereby controlling the fluid flow rate of the of treatment fluid being pumped out of ports 216 and 218. More specifically, the modulating device 184 controls the speed of the floating piston 194 to ensure that the treatment fluid is pumped out of the modulator 32 at a very low, controlled flow rate. Although any suitable modulating device 184 may be used to control the speed of the floating piston 194, in the depicted embodiment, the modulating device 184 is a stepper motor with a linear encoder output. In that regard, the modulating device 184 includes a modulating device motor 226 having a modulating device output shaft 228 that is coaxially secured to a threated extension shaft 230. The threaded extension shaft 230 extends coaxially from the output shaft 228 for threaded engagement with a nut 238 of a first cylinder assembly 232.

The first cylinder assembly 232 includes a first cylinder 234 having a first cylinder bore 236 sized and configured to receive the nut 238 in its first end for axial translation with the nut 238 along the threaded extension shaft 230. The first cylinder 234 is disposed within a first end housing bore 250 of the first end housing portion 242 and has substantially the same external diameter as the internal diameter of the first end housing bore 250. A second end of the first cylinder 234 is engaged with or otherwise connected to the floating piston 194. Accordingly, the first cylinder 234 slides axially within the first end housing bore 250 and into and out of the central housing bore 248. To that end, a suitable sealing element, such as an O-ring (not shown) is disposed between the first cylinder 234 and the first end housing bore 250 to prevent any treatment fluid from escaping the second internal metered fluid cavity 224.

The distal end of the first cylinder 234 is affixed to the floating piston 194 for controlling the rate at which the floating piston 194 is moved axially within the central housing bore 248. More specifically, the modulating device motor 226 is actuated to rotate the output shaft 228, and therefore the threated extension shaft 230 about the axis of the extension shaft 230. When rotated in this manner, the nut 238 translates along the threaded extension shaft 230, thereby translating the cylinder 234 in one or two axial directions within the first end housing bore 250. The motor 226, which may be controlled by the control unit 34, controls the rate at which the threaded shaft 230 rotates, which thereby controls the rate at which the threaded nut 238 and the first cylinder 234 move, which thereby controls the rate at which the floating piston 194 moves axially within the central housing bore 248. Accordingly, the modulating device 184 is used to increase or decrease the speed at which the floating piston 194 reciprocates axially back and forth within the central housing bore 248, thereby controlling the rate at which the treatment fluid flows out of the first or second internal metered fluid 222 or 224.

The modulating device 184 can also send linear encoder output to the control unit 34 for processing, reporting, etc. As can be appreciated by one of ordinary skill, the speed, direction, linear distance, etc., traveled by the floating piston 194 can be tracked by the linear encoder (not shown) of the modulating device motor 226. Such data can be processed by the control unit 34 to assess the flow rate and volume of treatment fluid being pumped out of the modulator 32. To that end, the control unit 34 may also include a suitable interface for allowing an operator to input a desired flow rate and volume of treatment fluid to be pumped out of the modulator 32. The control unit 34 can include suitable circuitry for pre-programming the modulating device 184 or instead allowing the modulating device 184 to be controlled by an operator. Thus, the modulating device 184 allows for automatic control of the modulator 32 (and therefore, the device 20).

As noted above, the modulator 32 is also configured to selectively pump low pressure hydraulic fluid into the oscillator 28 for actuating the oscillator 28. In that regard, the modulator 32 further includes a second cylinder assembly 196 that both draws hydraulic fluid into the modulator 32 and pumps hydraulic fluid out of the modulator 32 toward the oscillator 28. The second cylinder assembly 196 is disposed within a second end housing bore 252 extending axially along the second end housing portion 244.

The second cylinder assembly 196 includes a second cylinder 202 slidably disposed on a fixed piston assembly 198 extending substantially coaxially within the second end housing bore 252. The fixed piston assembly 198 includes a fixed piston stem 200 that extends from a left side of the second end housing portion 244 that terminates in a fixed piston 208. The fixed piston 208 is slidably disposed within a second cylinder bore 206 of the second cylinder 202 and it has an external diameter that is substantially the same size as the interior diameter of the second cylinder bore 206. Moreover, the fixed piston 208 includes an annular groove to receive a sealing element, such as an O-ring (not shown), for dividing the second cylinder bore 206 into first and second cylinder bore cavities 214 and 220.

The first cylinder bore cavity 214 is in fluid communication with a first low pressure port 210 of the modulator 32 through a fixed piston bore 204 extending along the length of the fixed piston assembly 198. The second cylinder bore cavity 220 is in fluid communication with a second low pressure port 212 of the modulator 32. Accordingly, as the second cylinder 202 is moved to the left and right, hydraulic fluid in one of the first and second cylinder bore cavities 214 and 220 is pumped out of the corresponding first or second low pressure port 210 or 212 by the fixed piston 208. At the same time, hydraulic fluid is drawn into the other of the first and second cylinder bore cavities 214 and 220.

More specifically, hydraulic fluid is drawn into the first cylinder bore cavity 214 (through the first low pressure port 210 and the fixed piston stem bore 204) as the second cylinder 202 is moved to the right due to the negative pressure or suction force of the expanding first cylinder bore cavity 214. At the same time, hydraulic fluid is pumped out of the second cylinder bore cavity 220 (and out the second low pressure port 212 of the modulator 32) by the pumping effect of the fixed piston 208 within the second cylinder 202.

When the second cylinder 202 is moved to the left, hydraulic fluid is drawn into the second cylinder bore cavity 220 through the second low pressure port 212 due to the negative pressure or suction force of the expanding second cylinder bore cavity 220. At the same time, hydraulic fluid is pumped out of the first cylinder bore cavity 214 (through the fixed piston stem 204 and out the first low pressure port 210 of the modulator 32) by the pumping effect of the fixed piston 208. The hydraulic fluid pumped out of the first and second cylinder bore cavities 214 and 220 is directed toward one of the first and second biasing assembly cavities 102 or 128 of the oscillator 28 for selective actuation of the oscillator 28, as will become apparent below.

The second cylinder 202 is moveable left and right by the movement of the floating piston 194. In that regard, the right end of the second cylinder 202 is secured to the floating piston 194 such that it is moveable axially by the floating piston 194. As such, the second cylinder 202 is moveable into and out of the central housing bore 248 for movement with the floating piston 194. Thus, a suitable sealing element or assembly (not shown) is disposed around the second cylinder 202 such that fluid does not flow between the second end housing bore 252 and the central housing bore 248.

Referring to FIGS. 11-12, operation of the high pressure volumetric metering device 20 will now be described. Referring specifically to FIG. 11, the device 20 is shown in a first configuration having a first fluid flow path. In this first configuration, treatment fluid flows from the treatment fluid supply through the high pressure lines 52 toward both the oscillator 28 and the differential pressure regulator 24. Specifically, treatment fluid flows into port 60 of the differential pressure regulator 24 and into port 168 of the oscillator 28. The slide valve 124 of the oscillator 28 is positioned in its left-most position, and as such, the treatment fluid flows into the fourth slide valve port 164 of the slide valve 124, out the third slide valve port 162 of the slide valve 124, out the first modulator interface port 174 of the oscillator 28, and thereafter into port 216 of the modulator 32.

In the first configuration, the floating piston 194 of the modulator 32 is in its left-most position. As a result, the treatment fluid enters port 216 of the modulator 32 and imparts pressure on the floating piston 194 to move the floating piston 194 to the right, thereby driving a predetermined volume of treatment fluid in the second internal metered fluid cavity 224 out of the modulator 32 through port 218. The flow rate of the metered treatment fluid being pumped out of the modulator 32 is controlled by the modulating device 184. Specifically, as described in detail above, the modulating device 184 controls the speed of the floating piston 194, thereby controlling the flow rate of metered treatment fluid exiting the modulator 32.

The treatment fluid flows out of port 218 of the modulator 32, into the second modulator interface port 176 of the oscillator 28, into the second slide valve port 160 of the slide valve 124, out the first slide valve port 158 of the slide valve 124, and finally out port 170 of the oscillator 28 toward the differential pressure regulator 24. The treatment fluid flows into port 68 of the differential pressure regulator 24, and exits port 64 after passing through the second pressure regulator cavity 76. The differential pressure regulator 24 maintains the pressure differential between ports 60 and 68, as described in detail above, to outlet the predetermined volume of treatment fluid to the process line at a specific controlled pressure, regardless of fluctuations in the device 20 itself or in the process line.

In this first configuration, the hydraulic fluid is also moving through the device 20 to appropriately actuate the oscillator 28. Generally, hydraulic fluid is drawn into one of the first and second cylinder bore cavities 214 and 216 of the modulator 32, and it is pumped toward one of the first and second biasing assembly cavities 102 and 128 of the oscillator 28 for compressing or otherwise pre-loading the corresponding biasing assembly 104 or 130. The biasing assembly 104 or 130 extends or unloads when the corresponding valve 48 or 46 opens to force hydraulic fluid into the corresponding first or second slide valve piston cavity 112 or 138 to impart pressure on the first or second slide valve piston 118 or 114, thereby moving the slide valve 124 to the left or right.

In the first configuration shown in FIG. 11, the hydraulic fluid has entered the second spring cavity 128 and compressed or loaded the second biasing assembly 130. In addition, the first valve 42 directs the flow of hydraulic fluid from the hydraulic fluid reservoir 36 into the first low pressure port 210 of the modulator 32. The hydraulic fluid is drawn through the first low pressure port 210 and into the first cylinder bore cavity 214 by movement of the second cylinder 202 (through movement of the floating piston 194) to the right. As the second cylinder 202 is moved to the right, the hydraulic fluid in the second cylinder bore cavity 220 is pumped out of the second low pressure port 212 of the modulator 32.

FIG. 12 shows a second configuration of the device 20 allowing a second fluid flow path, where the floating piston 124 of the modulator 32 has been moved all the way to the right, and the floating piston 124 is beginning to move back to the left. When moved to the left, the second cylinder 202 also moves to the left, thereby pumping hydraulic fluid out of the first cylinder bore cavity 214 through the first low pressure port 210 of the modulator. Around the same time, the second valve 44 directs hydraulic fluid to be drawn from the reservoir 36 into the second low pressure port 212 and into the second cylinder bore cavity 220.

The second valve 44 also directs the hydraulic fluid that has been pumped out of the second low pressure port 212 (as shown in FIG. 11) to flow into the first biasing assembly cavity 102 of the oscillator 28, compressing or loading the first biasing assembly 104. Around the same time, the third valve 46 opens and the second spring 134 of the second biasing assembly 130 extends or unloads to force hydraulic fluid out of the second biasing assembly cavity 128 and into the second oscillator internal fluid cavity 138. The pressure of the hydraulic fluid moves the second slide valve piston 144 to the right, thereby moving the slide valve 124 to the right. After the slide valve 124 has been moved to the right, the hydraulic fluid is directed back to the hydraulic reservoir 36 through the third valve 46.

In the right-most slide valve configuration, the third slide valve port 162 is now in fluid communication with the second modulator interface port 176 to direct treatment fluid to the second high pressure port 218 of the modulator 32. In that regard, treatment fluid flows from the treatment fluid supply source into port 168 of the oscillator 28, through the fourth slide valve port 164 of the slide valve 124, out the third slide valve port 162 of the slide valve 124, out the second modulator interface port 176 of the oscillator 28, and thereafter into port 218 of the modulator 32.

After entering the modulator 32, the treatment fluid imparts pressure on the floating piston 194 to move the floating piston 194 to the left, as noted above, thereby driving the predetermined volume of fluid within the first internal metered fluid cavity 222 out of the modulator 32 through port 216. The flow rate of the metered treatment fluid being pumped out of the modulator 32 is again controlled by the modulating device 184.

The treatment fluid flows out of port 216 of the modulator 32 into the third modulator interface port 178 of the oscillator 28, into the second slide valve port 160 of the slide valve 124, out of the first slide valve port 158 of the slide valve 124, and finally out of port 170 of the oscillator 28 toward the differential pressure regulator 24.

Referring back to FIG. 11, the hydraulic fluid is thereafter pumped out of the first biasing assembly cavity 102 by the force of the first biasing assembly 104 when the fourth solenoid valve 48 opens. The hydraulic fluid enters port 114 of the oscillator 28 to move the first slide valve piston 118 back to the left, thereby moving the slide valve 124 back to the left. After the slide valve 124 has been moved back to the left, the hydraulic fluid is directed back to the hydraulic reservoir 36 through the fourth valve 48.

As can be appreciated from the configurations shown in FIGS. 11 and 12, the slide valve 24 of the oscillator 28 continues to reciprocate back and forth between first and second (or left and right) positions to selectively direct treatment fluid flow to the modulator 32. At the same time, the modulator 32 pumps a controlled volume of treatment fluid out of one of the first or second internal metered cavities 222 or 224 toward the differential pressure regulator 24 while pumping hydraulic fluid into the oscillator 28 for continual reciprocation of the slide valve 124. In other words, the high pressure volumetric metering device 20 is completely self-regulating.

As noted above, a control unit 34 is configured to control the oscillator 28 and modulator 32 for maintaining a desired treatment fluid flow rate while accurately measuring the volume of treatment fluid passing through the device 20. More specifically, the control unit 34 may include suitable circuitry for activating and controlling the speed, direction, etc., of the modulating device motor 226 to control the movement of the floating piston 194 and therefore the fluid flow rate of the treatment fluid being pumped out of the modulator 32. In other words, an operator can input a desired treatment fluid flow rate into the control unit 34, and the control unit 34 outputs the appropriate signals to activate and direct the modulating device motor 226. Accordingly, it can be appreciated that the device 20 can be used to pump treatment fluid at very low, controlled fluid flow rates. Furthermore, the control unit 34 may be configured to receive and process encoder data or other measurement data from the modulating device 184 to accurately measure the volume of treatment fluid flowing out of the modulator 32 and ultimately into the process line.

Moreover, the control unit 34 may also be used to selectively open the first, second, third, and/or fourth valves 42, 44, 46, and/or 48 for selectively directing the flow of hydraulic fluid to and from the modulator 32, and for selectively directing the flow of hydraulic fluid to and from the oscillator 28 for moving the slide valve 124 in one of first or second (or left or right) positions.

The control unit 34 may any suitable electronic client device, such as a computer, personal digital assistant, cell phone, tablet computer, or any other suitable device in which computer software or other digital content may be executed. The electronic client device can be controlled either directly or by a remote connection using industry standard communication protocols such as HART, Modbus, 4-20 mA, and H1, as well as other protocols.

While illustrative embodiments have been illustrated and described, it will be appreciated that various changes can be made therein without departing from the spirit and scope of the present disclosure.

The embodiments of the present disclosure in which an exclusive property or privilege is claimed are defined as follows:

1. A high pressure volumetric fluid metering device for controlling the flow of fluid from a high pressure fluid supply source to a process line, comprising:

a modulator configured to pump a first metered volume of high pressure fluid at a controlled flow rate, the modulator comprising:

a modulator housing having a first high pressure port and a second high pressure port;

a piston that is moveable within the housing into a first position when high pressure fluid enters the first high pressure port and moveable into a second position when high pressure fluid enters the second high pressure port, and wherein the piston pumps the first metered volume of fluid out of the modulator housing when the piston is moved into the first position; and a modulating device operably coupled to the piston for reducing the speed of the piston when the piston moves within the housing between the first and second positions to control the flow rate of the first metered volume of fluid out of the modulator housing;

an oscillator in fluid communication with the high pressure fluid supply source, the oscillator configured to selectively direct high pressure fluid from the high pressure fluid supply source toward the modulator, the oscillator further configured to direct the first metered volume of high pressure fluid pumped out of the modulator toward an oscillator outlet; and a differential pressure regulator configured to substantially maintain the pressure differential across the modulator and oscillator.

2. The device of claim 1, wherein the differential pressure regulator includes a first high pressure inlet port in fluid communication with the high pressure fluid supply source, a second high pressure inlet portion in fluid communication with the oscillator outlet, and an outlet port in fluid communication with the process line.

3. The device of claim 2, wherein the differential pressure regulator substantially balances the pressure of fluid between the first high pressure inlet port and the second high pressure inlet port as the fluid exits the outlet port.

4. The device of claim 1, wherein the oscillator includes a slide valve that is moveable between first and second positions, wherein the slide valve directs high pressure fluid into the first high pressure port of the modulator in the first position, and wherein the slide valve directs high pressure fluid into the second high pressure port of the modulator in the second position.

5. The device of claim 1, further comprising a control unit having circuitry for receiving input from a user selecting a flow rate of the high pressure fluid, and circuitry for outputting signals to the modulating device for activating the modulating device to move the piston.

6. The device of claim 5, wherein the modulating device includes a linear encoder configured to track at least one of the speed, direction, and linear distance of the piston.

7. The device of claim 5, wherein the control unit further includes circuitry for receiving linear encoder output signals and circuitry for processing the linear encoder output signals for assessing at least one of the flow rate and volume of the flow of fluid to the process line.

8. The device of claim 1, wherein the piston pumps a second metered volume of fluid out of the modulator when the piston is moved into the second position, the first metered volume of fluid substantially equivalent to the second metered volume of fluid.

9. The device of claim 8, wherein the piston divides the modular housing into first and second internal metered fluid cavities having first and second volumetric capacities determined by the axial position of the piston within the modulator housing.

10. The device of claim 9, wherein the first metered volume of fluid is defined by the first internal metered fluid cavity and the second metered volume of fluid is defined by the second internal metered fluid cavity.

11. The device of claim 1, wherein the modulating device is a stepper motor with linear encoder output.

12. A method of controlling the flow of fluid from a high pressure fluid supply source to a process line, comprising:

selectively directing high pressure fluid from the high pressure fluid supply source through a first high pressure fluid flow path of an oscillator toward a modulator;

pumping a first metered volume of high pressure fluid from the modulator to the oscillator with a piston while controlling the speed of the piston;

directing the first metered volume of high pressure fluid through a second flow path of the oscillator toward a process line; and maintaining a substantially constant pressure drop between a first high pressure fluid inlet port and a fluid outlet port leading to the process line.

13. The method of claim 12, further comprising moving the piston into a first position when high pressure fluid enters the modulator from the first fluid flow path, wherein the piston pumps the first metered volume of fluid out of the modulator when the piston is moved into the first position.

14. The method of claim 13, further comprising:

selectively directing high pressure fluid from the high pressure fluid supply source through a third high pressure fluid flow path of an oscillator toward a modulator;

pumping a second metered volume of high pressure fluid from the modulator to the oscillator; and directing the second metered volume of high pressure fluid through a fourth flow path of the oscillator toward a process line.

15. The method of claim 14, further comprising moving the piston into a second position when high pressure fluid enters the modulator from the third fluid flow path, wherein the piston pumps the second metered volume of fluid out of the modulator when the piston is moved into the second position.

16. The method of claim 12, further comprising:

directing high pressure fluid from the high pressure fluid supply source to the first high pressure inlet port, wherein the first high pressure inlet port is defined by a of the differential pressure regulator;

directing high pressure fluid from the differential pressure regulator to the oscillator;

selectively directing high pressure fluid from the oscillator to a second high pressure inlet port of the differential pressure regulator;

flowing the first metered volume of high pressure fluid out of the fluid outlet port defined by the differential pressure regulator to the process line; and substantially balancing the pressure of fluid between the first high pressure inlet port and the second high pressure inlet port as the fluid exits the outlet port.

17. A high pressure volumetric fluid metering device for controlling the flow of fluid from a high pressure fluid supply source to a process line, comprising:

a modulator, comprising:

a piston moveable within a housing and configured to pump a first metered volume of high pressure fluid out of the housing; and a modulating device operably coupled to the piston for reducing the speed of the piston when the piston moves within the housing to control the flow rate of the first metered volume of fluid out of the modulator housing;

an oscillator in fluid communication with the high pressure fluid supply source, the oscillator configured to selectively direct high pressure fluid from the high pressure fluid supply source toward the modulator, the oscillator further configured to direct the first metered volume of high pressure fluid pumped out of the modulator toward an oscillator outlet; and a differential pressure regulator configured to maintain a substantially constant pressure drop between a first high pressure inlet and a fluid outlet leading to the process line.

18. The device of claim 17, wherein the differential pressure regulator defines the first high pressure inlet port in fluid communication with the high pressure fluid supply source, a second high pressure inlet portion in fluid communication with the oscillator outlet, and the fluid outlet port in fluid communication with the process line.

19. The device of claim 18, wherein the differential pressure regulator substantially balances the pressure of fluid between the first high pressure inlet port and the second high pressure inlet port as the fluid exits the outlet port.

20. The device of claim 17, wherein the modulating device is a stepper motor with linear encoder output.

* * * * *